US005761583A

United States Patent [19]

Custer

[11] Patent Number: 5,761,583

[45] Date of Patent: Jun. 2, 1998

[54] LIQUID NITROGEN PRINTING PROCESS AND APPARATUS AND TONER COMPOSITION

[76] Inventor: Peter Custer, P.O. Box 367, Providence, R.I. 02901-0367

[21] Appl. No.: 721,581

[22] Filed: Sep. 25, 1996

[51] Int. Cl.[6] ..... G03G 15/10; G03G 9/00

[52] U.S. Cl. ..... 399/248; 430/112; 430/116; 430/117

[58] Field of Search ..... 399/237, 248; 430/105, 116, 112, 114, 117

[56] References Cited

U.S. PATENT DOCUMENTS 3,776,757 12/1973 Eastman et al. ..... 430/112 X 4,734,351 3/1988 Kitatani et al. ..... 430/116 X

*Primary Examiner*—S. Lee

*Attorney, Agent, or Firm*—Banner & Witcoff, Ltd.

[57] ABSTRACT

A cryogenic liquid, particularly liquid nitrogen, is used as a non-conductive fluid medium for freezing paper and as the liquid toner for electrostatic imaging. A web or sheet of paper is frozen using the cryogenic liquid to provide a dielectric surface for charged image areas to adhere to. The cryogenic liquid based toner carrier is particularly suitable for use in printing processes wherein a latent charge image is developed.

27 Claims, 1 Drawing Sheet

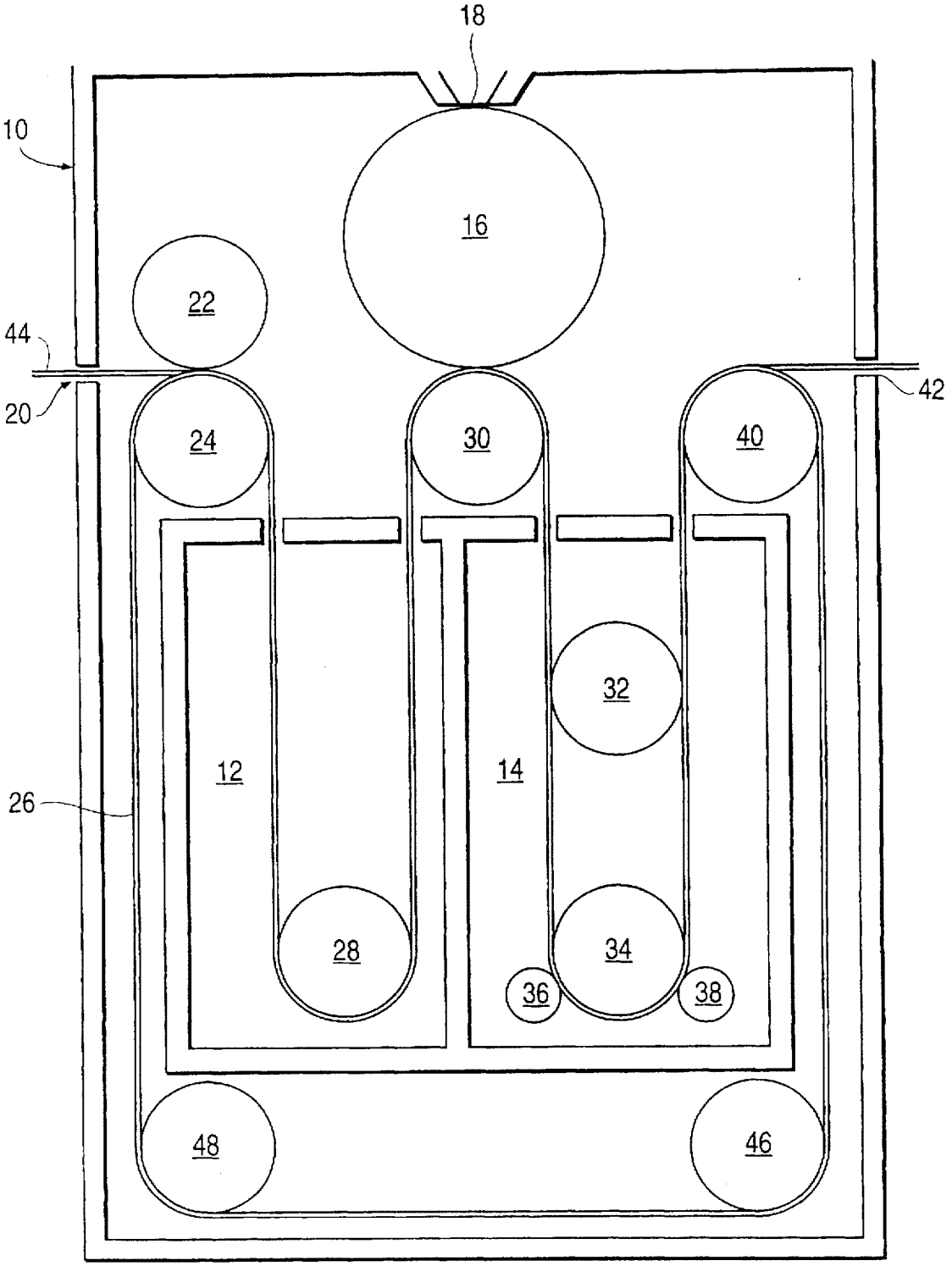
18
10
16
22
44
20
42
24
30
40
32
12
14
26
28
34
36
38
48
46

LIQUID NITROGEN PRINTING PROCESS AND APPARATUS AND TONER COMPOSITION

The present invention relates generally to printing and, more specifically, to electrostatic or xerographic printing and copying, wherein a latent charge image is formed on a drum, web, or sheet of material, and is developed into an actual print image by the application of particles of toner or developer with an inherent opposite polarity (positive or negative) to the charged image areas. The present invention further relates to a process of freezing a web or sheet of paper by a cryogenic liquid to provide a dielectric surface for the charged image areas to adhere to. The present invention further relates to the use of a cryogenic liquid, particularly liquid nitrogen, as a non-conductive fluid medium for freezing paper and as the liquid toner for electrostatic imaging.

A great variety of printing processes have been developed over the years, including a number of semiconductor- or photoconductor-based constructions, wherein a visible light image is focused on a substrate to selectively discharge regions of the surface, and a number of charge transfer processes wherein a charge is deposited onto the substrate. The latter includes electrostatic processes, wherein a pin array creates the electrostatic latent image by spark discharges; ionographic processes, wherein ions are projected from a corona chamber to form the charge pattern; and charge deposition processes involving electron beam writing, or the projection of electrons or ions from charge transfer cartridges or print heads composed of arrays of multiple electrodes crossing at discharge sites. TESI or Transferred Electrostatic charge imaging can also be achieved from a charge image first established by photoconductive discharge by laser beam on a drum or endless belt loop of PC material. Other processes include magnetic imaging processes. The foregoing approaches to imaging have been highly developed, and resolutions of 300 dots per inch or greater are readily obtained, with several of the processes offering resolution many times greater.

In general, the development of a visible image in any of the foregoing copying or printing processes entails application of a toner or developer to the latent image. This is generally done by applying the toner in a flowing powder or liquid form to the latent imaging surface, causing the toner to adhere only to the oppositely charged image areas. A great many active developing agents and formulations have evolved over the years, including airborne particles, carrier-borne suspensions of particles, solvated inks or chemically active dyes in a carrier or suspension, and emulsions of such materials. The current generation of toners typically employs small particles comprising a pigment, such as carbon powder, and a solid body, such as a plastic or wax binder which contains the pigment. The pigment is generally a sub-micron, light absorbing particle.

One or more of the components may be adapted to introduce gelling solvent swelling, or heat or pressure fusing properties of the particles, so that the final image may hold its shape, be well consolidated during intermediate or final processing, or become tacky and transfer more readily at an appropriate temperature. When a dry powder toner is used, as is most prevalent in the current generation of machines, components, such as magnetic powder, may be included to make the composition easily applicable or readily stirred by mechanisms such as magnetic brushes or magnetic stirrers. A charge may be obtained using dry powder toner particles by either tribo-electric charging (rubbing particles together) or by adding a magnetic iron particle, for example, to impart or transfer a charge to the toner particles.

When the toner is liquid, the carrier liquid is generally an insulating, non-polar and non-toxic hydrocarbon carrier, such as an isoparaffinic liquid. While earlier developers employed materials such as aromatic, lower alkane, and halogenated hydrocarbon solvents, these ingredients generally have been discontinued due to their toxicity, flammability, and other undesirable traits.

In general, with dry powder developers, if the size of toner particles is decreased to enhance resolution, problems of dust control within the applicator mechanism increase. Better resolution is achieved by liquid developers, at least on flat substrates or filled papers, because the processes wherein the latent image attracts suspended particles in a fluid to the image surface is a gentle process requiring very little energy, thus lacking mechanical contact characteristics of toner brush applicators. However, liquid developers require the removal of solvent or carrier from the final image.

As noted above, the carrier is generally an isoparaffinic solvent that has a low molecular weight, is colorless, and can be tolerated in the workplace at fairly high concentrations. Such carrier liquids are available in a variety of weight ranges, and may be obtained with quite low viscosities. Nonetheless, for high-volume or high-speed printing, the management of carrier may require complex constructions, or may have substantial environmental consequences. Thus, while this class of liquid toners continues to be used on low-end machinery where the mature state of its technology offers excellent image quality for a low cost, limitations make it less useful for the volume and speed requirements of modern electrographic imaging uses.

A consensus exists in the printing industry that, in the next century, most high-quality color printing will be done straight from computer to press. Liquid toner electrostatic imaging is basic to this new technology as the best, least complex, least costly way to achieve high resolution and press speeds, yet is restricted by the present requirement that volatile organic compounds, such as Isopar, be used as a non-conductive fluid in which the imaging toner particles are suspended. Added to the substantial cost of such organic compounds are the costs of containing its vapors and of disposing it when expended, and the safety considerations due to its flammability.

Accordingly, a liquid toning process with decreased environmental impact is desirable. It would also be desirable to provide a liquid toner of low cost and negligible toxicity. It would be further desirable to provide a liquid toner with distinct imaging advantages for diverse printing tasks.

SUMMARY OF THE INVENTION

The present invention is directed to freezing a substrate, such as paper stock, in order to provide a dielectric surface to which a latent charged image is applied. The substrate is frozen using a cryogenic liquid such as liquid nitrogen. In addition, the present invention is directed to the use of a cryogenic fluid, in particular liquid nitrogen, as the carrier in a toner formulation.

Liquid nitrogen is a non-conductive fluid which has high resistivity, a low dielectric constant, and a low viscosity. Ice, as a frozen water component of the molecular structure of paper, is a non-conductor of electricity. Thus, paper which is immersed in liquid nitrogen and frozen becomes a dielectric surface suitable to accept and hold a deposited or transferred electrostatic charge image that is next toned by frozen ink/ice particles of opposite charge in liquid nitrogen. Sharp and dense images on both a dielectric surface and directly on paper, which has been frozen in liquid nitrogen at −320° F., can be achieved.

A black, coloring, or marking agent, such as a powder, aerosolized pigment formulation, or the like, is mixed in a body of liquid nitrogen to form dispersed color particles in the liquid nitrogen. The liquid nitrogen is then contacted to a latent charge image on a substrate so that the oppositely charged pigment/toner charged particles adhere to imaging regions. Four frozen colors can be printed one over the other without bleeding or capillary wicking, to be next "freeze-dried" by vacuum sublimation, for example.

Since the liquid nitrogen itself is electrically insulating and has extremely low viscosity, the imaging member is wetted and an image is readily formed with high resolution. The liquid nitrogen carrier then evaporates harmlessly and nearly instantaneously to the atmosphere.

Advantageously, the liquid nitrogen does not conduct, so as to dissipate charge, and its valence electrons do not participate to any extent in interactions with regions of positive or negative charge on the imaging member. Thus liquid nitrogen does not interfere during the high speed transit of the opposite charge imaging particles through the liquid nitrogen to the charge image surface on the frozen paper. Liquid nitrogen has a viscosity many times lower than that of common liquid carriers, e.g., one-tenth that of Isopar, allowing high-speed application to be achieved, and greatly reducing the level of mechanical wiping action caused by motion of the imaging member. Liquid nitrogen is safe and simple to work with, pumped, and dealt with as though water and, like water, is ubiquitous and environmentally innocent. Liquid nitrogen is also inexpensive at only a few cents per pound.

The present invention can be used with any electrostatic printing process, particularly high-speed, high-resolution ion-deposition and laser-exposed electrostatic liquid toner imaging. Such printing processes are particularly suited for computer-generated and stored variable text, graphics, and data which are printed in full process color on both sides of a paper web in a single, high-linear speed press pass.

An apparatus according to the present invention includes a double-walled, insulated and vacuum air-evacuated structure. Within the structure is a rotating photoconductor drum and two containers to hold the cryogenic liquid, such as liquid nitrogen. (For ease of discussion, a liquid nitrogen-based toner will be discussed although it is to be understood that any suitable cryogenic liquid may be used.) The first container operates to freeze the substrate such as a paper web. In the second container is a liquid nitrogen-based toner containing suspended, frozen, submicron particles or crystals of pigment and binder of opposite polarity, so as to be attracted to the charge image.

The charge image to be transferred to the paper web is first created on the photoconductor rotating drum or on a photoconductor continuous loop belt by laser light exposure, and that negative charge is by contact or near contact transfer printed onto the frozen paper.

Alternatively, the charge image can be printed directly onto the frozen dielectric surface of the paper web from a high-voltage stylus array, or by magnetic charge deposition, or any other suitable means to establish the charge image. In a preferred embodiment, a direct corona charge prints an image directly onto the frozen paper.

The liquid nitrogen-based toner contains a pigment plus suitable binder which is sprayed or high velocity injected as droplets or as a continuous micro-thread mechanically shattered into toner particles. These frozen imaging particles then adhere to the paper by the opposite polarity static charge image on the dielectric surface of the paper frozen by immersion in liquid nitrogen.

The particles are then melted to the sticky stage, in which they adhere to the paper. Alternatively, the water is extracted from the frozen particles by transmitting the paper through a vacuum sublimination chamber where the particles are, in effect, dried. In addition, the particles may be hardened by cross-linking through exposure to intense ultraviolet, as done in other printing processes, while still in the frozen state or after being melted.

It is to be understood that both the foregoing general description and the following detailed description are exemplary and explanatory only and are not restrictive of the present invention as claimed.

BRIEF DESCRIPTION OF THE DRAWINGS

These and other features of the invention will be understood from a description below, with reference to the following drawings, wherein:

FIG. 1 shows a schematic representation of the print stage structure of a printer in accordance with the present invention.

DETAILED DESCRIPTION

The present invention is directed to a printing process wherein a latent charge image is developed using a toner formulation having a cryogenic liquid, preferably liquid nitrogen, as a carrier. The present invention is also directed to freezing a substrate, such as paper stock, prior to application of the latent charge image and subsequent development. In particular, the present invention uses a cryogenic liquid, preferably liquid nitrogen, to freeze the substrate.

The toner formulation is a pigment suspended in a non-conductive cryogenic liquid, preferably liquid nitrogen. The pigment may be any pigment which can be suspended, including finely divided colored material, atomized liquid ink, or detectable marker materials, such as coloring agents, dyes, inks, magnetically detectable materials, and fluorescent materials. The pigments are very fine particles that have charge characteristics (+or−).

A substrate, such as a paper web, is first immersed in liquid nitrogen (or any other suitable non-conductive cryogenic liquid) to freeze the paper and provide a dielectric surface, and then receives a charged image. The substrate is then immersed in a liquid nitrogen-based toner so that the pigment binds to the charged image.

A preferred embodiment of the present invention is set forth in FIG. 1, which depicts a double-walled, insulated and air-evacuated structure (10). Preferably, the structure is a foam-insulated DeWar cryogenic print stage container box, optionally silvered. The structure is typically about a meter tall but can be any size.

Laser light modulated by computer data, exposes an image onto a rotating photoconductor drum (16) through a window slit aperture (18). The data is binary with no gray scale. The aperture contains a glass window, optically flat and optionally warmed or at least excluded from atmospheric moisture which would freeze and make the window opaque. Alternatively, the aperture contains no glass and the drum is exposed directly.

Any conventional or new electron source may be used to expose the image onto the rotating drum. Such sources include, but are not limited to, electron guns used in cathode ray tube or a carbon nanotube field-emission electron source.

Prior to the image exposure, the rotating drum surface may first be exposed to low intensity radiation, such as light, so as to raise the threshold for image printing by the scanning laser beam. Such a procedure is described in U.S. Pat. No. 4,929,529 and is hereby incorporated by reference. The drum surface may also be subjected to a charge corona to form a corona charge on the surface of the drum. Exposure to low radiation and corona discharge, and exposure of the drum to an image can be done using devices known in the electrostatic imaging field.

The drum may contain liquid nitrogen to maintain the photoconductor at or near cryogenic temperatures. For instance, in some cases the liquid nitrogen may provide an advantage in speed and/or image resolution. Typically, the instant of charge and image transfer to a paper web is so brief, and the paper is so solidly frozen at this point, no heat is exchanged between drum and paper surface and liquid nitrogen to cool the drum is not necessary.

Preferably, the drum does not come into contact with the paper since the charged image will transfer across a gap between the drum and the paper. Thus, the drum should not require cleaning, since it is only transferring a charge to the paper and should never wet with toner. However, residual toner does tend to build up on the drum and a means to remove the toner and any residual image, such as a strong corona field, should be included prior to application of the next charge image. Abrasives should never be applied to the drum since these could limit the life expectancy of the drum. The drum should endure many cycles of image charge and transfer to the frozen dielectric surface of the high-speed web.

After the charge image is transferred to the paper, any residual charge that exists on the drum is erased by, for example, a discharge lamp.

In the lower section of the structure beneath the drum are two liquid nitrogen containers placed side by side. (The containers may also instead contain any other suitable non-conductive cryogenic liquid.) The liquid nitrogen containers may actually be a single unit with two chambers or may be two separate units. Preferably the containers are DeWar tanks. The containers must be deep enough to achieve freezing of many different types and weights of paper.

The first container (12) contains liquid nitrogen and has a gaseous phase of nitrogen. Its function is to freeze the paper so that the paper becomes a dielectric. The gaseous phase and liquid phase are at a temperature of about −320° F. Liquid nitrogen is, in fact, coldest at the transition point between liquid and gas.

The second container (14) contains a toner that is suspended in the liquid nitrogen. This container also has a gaseous phase.

A paper web (44) enters in a slit (20) in the structure, between two rollers (22) and (24), and is placed against a continuous loop belt (26) that supports the web and transports it through the imaging operation. This belt may be perforated and is wider than the paper web.

A roller (28) is located within the liquid nitrogen tank (12) to guide the belt carrying the paper web into and out of the tank. By freezing to liquid nitrogen's temperature of −320° F., the water component of the paper fibers becomes, as ice, a non-conductor of electric charge. Thus, the paper itself becomes an effective dielectric on which a charged image is deposited and the paper toned.

A transfer roller (30), directs the belt/paper web beneath the photoconductor drum whereby the charge image is transferred from the drum to the paper. A point of transfer of the charge image is established from the drum to the non-conductive dielectric frozen surface of the paper. The transfer roller may be used to attract or pull down the charge from one surface onto another by opposite charge. The belt/paper web is then immersed into the second liquid nitrogen container.

In the second container, roller (32) and turn-back roller (34) provide a variable immersion of the paper web in the toner. The two rollers control the time and match changes in the web speed and the press paper speed, and thus adjust image densities (balance the colors). By reducing the time of a particular color and toner, it is possible to balance the density.

On the bottom, the turn-back roller (34) is moved up and down so as to provide a variable speed. This variable speed can be achieved, for example, by lifting and lowering the roller by cables operated by speed sensors or operator judgment. The speed of the belt through the second container may be based, for example, on the desired toner density.

Turn-back roller (34) is a dumbbell shape so that the it contacts the edges of the belt (which is wider than the paper) but does not contact the toned image surface on the paper. Two pressure rollers (36) and (38) press against the backside of the belt and also against the rims of the turnback roller. The pressure rollers may be the length of the whole turn back roller. Alternatively, each pressure roller may be a set of two shorter rollers located at the rims of the turn-back roller.

The paper/belt then leaves the second container. The belt wraps around roller (40) and the paper is removed and exits through slit (42) in order to advance to the next color and/or to the image-fixing stage.

If desired, the entrance slit and/or exit slit may have a pair of pressure rollers (not shown) that serve to exclude ambient air and retain gaseous nitrogen. If not present, a "cloud" of frozen water vapor in the ambient air may be seen as gas escapes through the entrance or exit slits. Nitrogen gas, itself, is clear, as it is in the atmosphere. The paper web should be frozen nearly instantaneously to avoid problems with flashing of the moisture. If desired, the paper web may be pre-cooled external to entering the structure.

Below the two liquid nitrogen containers, is a space used for additional rollers (46) and (48) to guide the continuous loop belt around the liquid nitrogen containers and for replenishment of toner, agitation means, and fluid management pumps and pipes, and a belt-cleaning stage, if necessary. Also within the space is a tension mechanism to take up slack in the belt if needed to account for slack generated by adjusting take-up roller (34).

The diameter of all the belt wrap-around rollers is large enough to reduce bending stress on the belt. These belts endure many millions of imaging cycles, and too small a roller diameter will ultimately destroy a belt.

The belt is any suitable belt, but is preferably a composite of strong and flexible fibers (e.g. fiberglass) in the warp dimension with carbon fibers (conductors) in the woof (horizontal) dimension in order to localize the application of the charge. Brush contact can be made with the edges of the carbon fiber woof threads in order to provide an attracting charge opposite to the charge of the source, e.g. drum to pull down the image from the drum to the surface of the paper. This type of belt has great strength, being a composite, and will last long enough to be practical.

A stainless steel belt can be used but would conduct any charge put at any point on the belt to the entire belt.

The belt may also be formed of a mylar film on an unextendable base material. The belt should have a dielectric surface capable of holding a charge without dissipation of the charge over the time intervals relevant to a printing process.

The frozen paper—as a dielectric —may have a ground plane if needed. Providing a ground plane is easily achieved with a stainless steel belt and is also possible with a fabric belt using carbon fibers as the woof. The ground plane may also be achieved by including a conductive sublayer which, in various processes, operates as a counter electrode to facilitate original charging, charge transfer, or toner acquisition or transfer. A ground plane should not be necessary, however, since imaging is rapid and dense when a charged paper surface is immersed in liquid nitrogen.

The paper, once frozen, can stay frozen through the four-color toner stages to be fixed to the paper as long as the image does not shear off. If the image shears off, the color toner from one tank could contaminate the color of the next. So, in the sequence of freezing, toning, and fixing the steel belt and/or the paper surface may be heated and cooled repeatedly.

The toner is solid at liquid nitrogen temperatures and sticky at higher temperatures. Toner material may be virtually any conventional powdered toner formulation, such as a toner comprised of pigmented wax or polymer particles, typically having a size range of submicron to thirty microns, or may even be a two or more component toner, that is, one having different particles of pigment material and of various other materials which may, for example, have functions of facilitating magnetic mixing or performing some charge-directing function. Advantageously, however, magnetic particles are generally not required in the toner formulation for mixing or brush applicator functions, inasmuch as the extremely low temperature reduces the possibility of toner clumping, and the fact that it is a liquid suspension renders magnetic brush applicators and the like unnecessary.

The particles are preferably 2 microns or less to achieve high resolution. Suitable particles include positive or negative charge carbon black or colored pigments. These particles are solid at cryogenic temperatures, sticky on the paper surface at higher temperatures and then solid after crosslinking. Crosslinking may be achieved using a suspension polymer and exposure to ultra violet light.

The pigment can be compounded by any of a number of well known processes such as a high-speed disc disperser, attritor, or ball mill. The pigment is then combined with a vehicle based on for example, but not limited to, a synthetic polymer emulsion (e.g., acrylic, styrene-acrylic, vinyl acetate), a partially esterified rosin or shellac, or a derivatized cellulose (e.g., hydroxyethyl cellulose). Any vehicle, synthetic or natural product or modified natural product that works, can be used. The pigment also could be preblended with the vehicle, e.g., by extrusion, prior to being dispersed in water. The choice of the vehicle depends on the end use, whether the printed material should be hard, tacky, flexible, glossy, matte, etc. Any vehicle currently used to make water-based coatings, paints, inks, etc. can be used. Compounding both reduces the average particle size of the dispersion and intimately commingles the ingredients.

Examples of acrylic polymer dispersions or emulsions would be the Rhoplex® series, sold by Rhom & Haas Company. Other ingredients, surfactants, antifoams, UV stabilizers, etc. can be added if necessary. Suitable surfactants include anionic, cationic, or neutral. Typically, the glass transition temperature of the emulsions ranges from −40° C. to greater than 50° C. Suitable binders, such as a water-based polymer, may also be present.

In one embodiment of the invention, an aqueous ink is formed into an aerosol and mixed into a body of liquid nitrogen, instantaneously solidifying as a suspension of iced pigment particles. In another embodiment, a dry powder toner formulation is mixed into a body of liquid nitrogen, again forming a suspension of solid particles in the carrier. A substrate containing a charged image is immersed in the liquid nitrogen toner formulation so that the toner or a pigment adheres to regions of electrical charge.

Although the pigment usually refers to a black or colored material for realizing a visible image on an imaging member, the pigment may also refer to other types of material. For example, numerous printing applications do not require that the image be visibly detectable by the human eye, but rather that it be detectable by specialized machinery. Thus, for example, magnetic powders, which are readable by magnetic check scanning machines, form a major application of electrostatic imaging devices. In this case, "pigment" simply refers to a marking material that is detectable in the imaged regions. Similarly, for various security applications, the pigment may be understood to mean a magnetic, fluorescent, or electroluminescent compound that becomes visible or detectable when stimulated with a proper security "key", such as ultraviolet light for a fluorescent ink, or a magnetic reader for a magnetic ink. In these cases, a pigment is understood to mean such a marker. Thus, while the word "pigment" is used below primarily interchangeably with, or at least primarily inclusive of, the words "ink" and "colored powder", it is understood to include, in this description and the claims appended hereto, the foregoing marker concepts, as well.

Frozen micro-spheres of toner can be created first as spray droplets, produced by any suitable means such as centrifuge or spray into gaseous nitrogen at the minus 320° F. phase change between liquid and gas at which liquid nitrogen is coldest. These frozen discrete particles of ice contain water as a carrier of particles of pigment which have either a positive or negative charge, and a polymer that serves to adhere the electrostatic imaging to paper at high press speed. To achieve sharp resolution, these particles are further reduced in mass to sub-micron diameter by vacuum sublimation in a continuous process to result in a sort of slurry of toner that is shipped in liquid nitrogen to the press room where it is diluted to any suitable tone-plus-liquid nitrogen concentration and serves to also, by automatic sensing, replenish the liquid toner to sustain charged toner pigment/liquid ratios, continuously adjusting in real-time for color saturation and four color image balance as the paper exits the high speed web press.

In a another method, micro-ice threads are created by high velocity injection through spinneretts into liquid nitrogen of a mix of water, charged pigment and polymer binder. The injected stream must have sufficient force to penetrate the liquid surface of liquid nitrogen before being near instantly frozen, else it is frozen on impact with the surface resulting in a useless mass of flat particles of too large size. These thin threads are further reduced in mass to sub-micron diameter by a continuous process of vacuum sublimation in which they are collectively drawn into a vacuum chamber supported by endless loop belts. These threads are shipped to the press in liquid nitrogen where they are mechanically shattered to form charged particles with a rod-like shape and diluted with the non-conductive liquid nitrogen vehicle. The logic of shipping toner as a frozen sludge or slurry is that liquid nitrogen, as a commodity is available throughout the world so there is little purpose in transporting large volumes of dilute toner from a central source.

The injector may, for example, be a solenoid or piezoelectrically actuated spray nozzle and is located to spray the ink into the body of liquid nitrogen. Preferably, a magnetic stirrer or other circulation-inducing element keeps the ink suspended. Alternatively, the injector may spray the ink onto the top surface of the liquid nitrogen. Upon contacting the liquid nitrogen, the sprayed ink immediately freezes, changing the state to become a suspended ice powder of pigment. Thus, the resulting formulation in the reservoir consists primarily of liquid nitrogen, with a pigment suspended therein.

The visual sensation of color printing is achieved by just three subtractive primary "process" colors, yellow, magenta and cyan plus black which absorbs all colors. These colors, when imaged aside one another as half tone dots or as dot on top of a dot, or printed in more advanced stochastic bits, reproduce, when mixed by the eye, the complete visible spectrum with considerable accuracy.

Electrostatic color printing is achieved by toners, of either positive or negative charge, of these 3 colors–traditionally pigments bound in micro-particles of these pigments in an adhesive substance, the two together assigned either positive or negative polarity by the addition of a third material known as a "charge director", many of which exist.

Creating a toner with either a positive or a negative charge characteristic, that is simpler and can secure high resolution, is achieved by adding the charge director at the molecular level. Because the ice crystal structure contains these charge directed pigments of sub-micron size, the particles have thus an inherent negative or positive charge, overriding other charge imparting phenomenon such as tribo-electric rubbing of particles by mechanical stirring or dielectrophoresis.

Because of the low dielectric constant and high insulating properties of liquid nitrogen and the electrophoresis phenomenon, some powders and liquid aerosols can acquire a particular charge in the toner reservoir. Thus, unlike conventional toning systems which require a preliminary charging mechanism, such as some form of brush, conductive carrier and biased housing, or tribo-electric charging mechanism to become dependably useful as electrostatic printing agents under the diverse environmental and charging conditions found in the field, the liquid nitrogen toning formulations of the present invention may develop a net charge and are highly efficient as pigmented toners for printing.

Example 1

A test was made to determine whether liquid nitrogen, in itself, would adversely affect the stability of a latent charge image on a dielectric member, for example, by conduction and discharge. A mylar film was charged by contact with a charging electrode maintained between −600 to −1200 volts. The mylar film was then immersed by dipping in liquid nitrogen for a period of time. The mylar was then removed and a dry toner was separately cascaded over the mylar surface to detect the presence of any remaining latent image. The latent charged image remained intact and clearly defined, and was able to attract and hold powder toner in the charged areas to form an image of those areas.

Example 2

Having determined that liquid nitrogen would not, itself, discharge a latent charge image, a toner formulation was prepared by adding a basic personal copier blue toner powder (sold by Ricoh) to a vessel of liquid nitrogen. The mixture was briefly stirred and then a charged mylar sheet was dipped into the liquid nitrogen/toner mixture. Toner particles readily adhered to the latent image, and a dense image with no background was obtained. When a sheet of paper was charged by the same technique and dipped in this toner formulation, an image was also obtained, although of lower density and with some background toner pick-up in the non-charged areas.

Example 3

A few tablespoons of commercially available Xerox 1075 toner were added to a container of liquid nitrogen and briefly stirred, as in Example 2 above. Dipping of a charged mylar sheet again produced a dense image with no background. As in Example 2, charged paper produced an image of somewhat lower density and visible background coloring. When the latent image on a mylar sheet was positively charged, the mylar sheet developed poorly.

Example 4

An Indian ink was placed in a graphic artist's airbrush assembly and made into an aerosol, which was directed at the surface of a vessel of liquid nitrogen. The aerosolized ink froze on contact with the liquid nitrogen, yielding a toner formulation of a suspended ice powder ink in liquid nitrogen. Another reservoir of toner was prepared using a red airbrush ink to form the aerosol. In each case, dipping mylar having a latent charge image on it into the iced toner formulation so prepared yielded a well-developed image with dense image areas and no discernible background toning. When the mylar sheets again returned to room temperature, warming the airbrush ink, the airbrush ink changed to a liquid state. By next contacting the thawed mylar to a sheet of plain paper, the ink image transferred with 100% efficiency at low contact pressure, and the final print image dried quickly by absorption and surface evaporation. Since the India ink was an aqueous preparation, the solvent evaporation only released harmless water vapor to the atmosphere.

The foregoing examples established that liquid nitrogen functions well as a carrier for pigment particles in a toner formulation for copying or printing applications, and may convert liquids, such as ink aerosols, into powder toners for cryogenic development with new and useful transfer or fixing properties.

It will be appreciated that liquid nitrogen is available as a bulk industrial commodity, costing only a few cents a pound, and is thus relatively inexpensive on a per-pound basis compared to typical non-toxic hydrocarbon-based liquids used as carriers, plasticizers, conditioners, or solvents in conventional imaging processes. Furthermore, the carrier residue, gaseous nitrogen, is not a toxic emission and has no known hazards associated with it, being present in normal air in very high levels. Accordingly, the use of liquid nitrogen as a carrier in a toner formulation allows all of the advantages of liquid toner applications, with none of the concomitant fire, cost, or toxicity issues traditionally associated with liquid carriers. Additionally, liquid nitrogen is substantially entirely non-wetting, has a viscosity roughly one-tenth that of the lightest carrier fluids commonly employed for toners, has a very low dielectric constant, which can cause the marker material to assume a positive or negative charge. It is, therefore, well adapted to direct toning of latent images, and, with suitable modifications to accommodate its low temperature characteristics, may be employed as a direct substitute for toning in a wide variety of known imaging processes.

It will be observed that with a liquid nitrogen toner, as described above, the usual procedures for print imaging, involving evaporation of an liquid carrier at one stage and/or the application of heat energy to melt and change the physical state and/or adhesion characteristics of the pigment at another stage, are reversed, to form a process whereby the toning operation is carried out at a cryogenic stage, and ultimate image fixing or drying then occurs passively at room temperature. Furthermore, the only solvent or carriers involved in the operation are the liquid nitrogen carrier, which harmlessly turns into nitrogen gas. There are no high temperature residues of a hot fusing process or unnatural liquids or extra chemical solvents involved in the procedure. Furthermore, the usual considerations of energy efficiency and heat dissipation, which arise with fusing and evaporation processes, are here reduced to the lesser problem of maintaining the cryogenic section at a suitably low temperature and controlling the rate at which the cryogenic liquid needs to evaporate or is bled out of the system. Since the cost of liquid nitrogen is only a few cents per pound, these considerations are readily addressed with relatively simple arrangements of separate chambers, sealing passages or openings between chambers, and similar plumbing design considerations. Because the liquid nitrogen naturally evolves into a gas, a number of these concerns are addressed simply by maintaining a rate of evaporation to ensure operation at positive pressures in a general outflow of nitrogen from the assembly into the surrounding environment.

Besides aqueous-based inks, it is clear that the image transfer process illustrated therein could equally well be effected using a suspended powder toner of a conventional type, for example, lamp black particles in beads of a low-melting point wax, suspended in a liquid nitrogen carrier. In that case, a conventional powdered toner image is left residing on the belt as it leaves the cryogenic-toning section, and transfer of the toned image from the belt to a receiving sheet could be effected using a counter-electrode, together with pressure, or using a release surface coating on the belt and a small amount of heat at the transfer station. However, in that case, while many advantages of the toning process would be realized, the further advantage of eliminating a heater or fusing element would not be entirely realized. However, lower melting temperature toner powders could be used, and a whole new class of such toner powders developed wherein the toner contains wax UV curable polymer, or even an oil binder that liquefies at low temperatures, e.g., −70° C., without incurring a risk of toner agglomeration in the reservoir. Great energy savings could be realized on account of the lower heat requirements in the fusing section.

Thus, the invention contemplates the use of liquid nitrogen as a carrier for a finely divided toner formulation which is contacted as a liquid suspension to an imaging member for forming a toned or developed image. In one of its broadest aspects, the invention comprises the realization that the properties of liquid nitrogen constitute an ideal carrier fluid for toning electrostatic images. As such, the invention may be readily adapted or modified to suit any one of thousands of imaging processes and machines developed over the last forty years or more that rely on such toning. In another of its broad aspects, the invention comprises the realization that, by reversing the temperature differentials normally encountered in printing, and supplying a cryogenic developer, the final fixing of an image may be accomplished without heat or pressure, or with greatly reduced heat, for a variety of print systems.

The invention being thus disclosed, modifications and adaptations to the art will be readily visualized and implemented by those of ordinary skill in the art, and all such variations, modifications, and adaptations are considered to be within the scope of the invention, as defined in the claims appended hereto.

What is claimed is:

1. A printing process comprising developing an electrostatic charge image using a toner formulation having a non-conductive cryogenic liquid as a carrier.

2. The printing process of claim 1 wherein the cryogenic liquid is liquid nitrogen.

3. A toner formulation comprising a toner suspended in a non-conductive cryogenic liquid.

4. The toner formulation of claim 3 wherein the cryogenic liquid is liquid nitrogen.

5. The toner formulation of claim 3 wherein the toner contains a pigment selected from the group consisting of a black pigment, a colored pigment, an ink, and a detectable marker material.

6. The toner formulation of claim 5 wherein the pigment is a detectable marker material selected from the group consisting of a coloring agent, a dye, an ink, a magnetically detectable material, and a fluorescent material.

7. The toner formulation of claim 3 wherein the toner further comprises a binder.

8. The toner formulation of claim 3 produced by centrifuging or spraying said toner into gaseous nitrogen at cryogenic temperatures producing frozen micro-spheres of the toner in liquid nitrogen.

9. The toner formulation of claim 8 further comprising subjecting the frozen micro-spheres to vacuum sublimation.

10. The toner formulation of claim 3 produced by high-velocity injection of the toner into liquid nitrogen to produce micro-ice threads of the toner in the liquid nitrogen.

11. The toner formulation of claim 10 further comprising subjecting the micro-ice threads to vacuum sublimation.

12. The toner formulation of claim 10 wherein the toner comprises pigment, water, and a binder.

13. A printing process comprising the steps of immersing a substrate into a first non-conductive cryogenic liquid to provide a frozen substrate, transferring an image to the frozen substrate, and then immersing the substrate into a second non-conductive cryogenic liquid containing a toner, wherein the toner adheres to the image.

14. The printing process of claim 13 wherein the first and second cryogenic liquids are liquid nitrogen.

15. The printing process of claim 13 further comprising transferring the image from a photoconducting drum containing the image.

16. A printing apparatus comprising means for immersing a substrate into a first non-conductive cryogenic liquid to provide a frozen substrate, means for producing an image on the frozen substrate, and means for immersing the substrate containing the image into a second non-conductive cryogenic liquid containing a toner.

17. The printing apparatus of claim 16 wherein the first and second cryogenic liquids are liquid nitrogen.

18. The printing apparatus of claim 16 wherein the means for producing the image on the frozen substrate comprises a photoconducting drum.

19. The printing apparatus of claim 16 wherein the means for producing the image on the frozen substrate comprises a corona discharge.

20. The printing apparatus of claim 16 wherein the means for immersing the substrate into the cryogenic liquids includes a continuous loop belt.

21. The printing apparatus of claim 20 wherein the continuous loop belt comprises woven nonconductive fibers and conductive fibers.

22. The printing apparatus of claim 21 wherein the continuous loop belt comprises woven fiberglass and carbon fibers.

23. The printing apparatus of claim 16 wherein the means for immersing the substrate includes first and second containers containing the cryogenic liquids.

24. The printing apparatus of claim 23 wherein the second container also contains speed adjustment means for the a belt.

25. The printing apparatus of claim 24 wherein the speed adjustment means includes a first roller, an adjustable turnback roller, and a second roller wherein the belt, having a backside and a front side, enters the second container, the second container having a top, the backside of the belt rolls against the first roller near the top of the second container, the belt is immersed deeper into the second container, the front side of the belt rolls against the adjustable turnback roller, the belt travels back up the second container, the backside of the belt then rolls against the second roller near the top of the second container, and the belt exits the second container.

26. The printing apparatus of claim 25 wherein the adjustable turnback roller is dumbbell shaped to make contact with only edges of the frontside of the belt.

27. The printing apparatus of claim 16 wherein the apparatus is contained in an insulated, air-evacuated structure.

* * * * *